US008476217B2

(12) United States Patent
Nomura et al.

(10) Patent No.: US 8,476,217 B2
(45) Date of Patent: Jul. 2, 2013

(54) NONIONIC SURFACTANT AND SURFACTANT COMPOSITION COMPRISING THE SAME

(75) Inventors: Masato Nomura, Wakayama (JP); Satoru Kijima, Wakayama (JP); Katsuhisa Inoue, Wakayama (JP); Tetsuaki Fukushima, Tokyo (JP); Tomoya Sato, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 13/502,859

(22) PCT Filed: Oct. 18, 2010

(86) PCT No.: PCT/JP2010/068278

§ 371 (c)(1), (2), (4) Date: Apr. 19, 2012

(87) PCT Pub. No.: WO2011/049045

PCT Pub. Date: Apr. 28, 2011

(65) Prior Publication Data

US 2012/0208738 A1 Aug. 16, 2012

(30) Foreign Application Priority Data

Oct. 19, 2009 (JP) ..... 2009-240154

(51) Int. Cl.
*C11D 1/72* (2006.01)
*C11D 1/722* (2006.01)
*C11D 1/825* (2006.01)

(52) U.S. Cl.
USPC ..... 510/360; 510/421; 510/505; 510/524; 510/535

(58) Field of Classification Search
CPC ..... C11D 1/72; C11D 1/722; C11D 1/825
USPC ..... 510/360, 421, 505, 524, 535
See application file for complete search history.

(56) References Cited

U.S. PATENT DOCUMENTS

| | | | |
|---|---|---|---|
| 4,832,868 A | 5/1989 | Schmid et al. | |
| 4,965,014 A | 10/1990 | Jeschke et al. | |

FOREIGN PATENT DOCUMENTS

| | | | |
|---|---|---|---|
| CN | 1215426 A | | 4/1999 |
| DE | 36 07 193 | | 1/1987 |
| DE | 36 43 895 | | 6/1988 |
| JP | 50 116384 | | 9/1975 |
| JP | 7 303825 | | 11/1995 |
| JP | 11 116995 | | 4/1999 |
| JP | 2004 91686 | | 3/2004 |
| JP | 2005 047871 | | 2/2005 |
| JP | 2006 70215 | | 3/2006 |
| JP | 2011 122037 | | 6/2011 |
| JP | 2011 162901 | | 8/2011 |
| WO | 2008 088647 | | 7/2008 |
| WO | WO 2008/088647 | * | 7/2008 |

OTHER PUBLICATIONS

U.S. Appl. No. 05/406,062, filed Oct. 12, 1973, Unknown.
Cox, M.F., et al., "Interactions Between LAS and Nonionic Surfactants," Surfactants and Detergents, Journal of the American Oil Chemists' Society, vol. 62, No. 7, pp. 1139-1143, (Jul. 1985).
International Preliminary Report on Patentability Issued May 15, 2012 in PCT/JP10/68278 Filed Oct. 18, 2010.
International Search Report issued on Dec. 7, 2010 in PCT/JP10/068278 Filed on Oct. 18, 2010.

* cited by examiner

*Primary Examiner* — Brian P Mruk
(74) *Attorney, Agent, or Firm* — Oblon, Spivak, McClelland, Maier & Neustadt, L.L.P.

(57) ABSTRACT

The present invention provides the nonionic surfactant represented by the formula (1):

$$R—O—(PO)_m-(EO)_n—H \quad (1)$$

wherein, R represents a saturated linear-chain hydrocarbon group having 8 to 18 carbon atoms, and n-octyl groups are 20 to 80% by mole of the saturated linear-chain hydrocarbon groups, n-decyl groups are 0 to 10% by mole of the saturated linear-chain hydrocarbon groups, and saturated linear-chain hydrocarbon groups having 12 to 18 carbon atoms are 20 to 80% by mole of the saturated linear-chain hydrocarbon groups; PO represents a propyleneoxy group; EO represents an ethyleneoxy group; m represents an average addition mole number of propyleneoxy groups ranging from 0.1 to 5; n represents an average addition mole number of ethyleneoxy groups ranging from 0.5 to 20; and $(PO)_m$ and $(EO)_n$ are bonded as blocks in this order.

10 Claims, No Drawings

NONIONIC SURFACTANT AND SURFACTANT COMPOSITION COMPRISING THE SAME

FIELD OF THE INVENTION

The present invention relates to a nonionic surfactant having a specified combination of hydrophobic chains and a surfactant composition containing the same.

BACKGROUND OF THE INVENTION

Nonionic surfactants produced by addition polymerization of aliphatic alcohols with alkylene oxides having 2 to 4 carbon atoms in the presence of a catalyst are widely used in various applications such as various detergents, emulsifiers, emulsifiers for emulsion polymerization, dispersants, solubilizers, wetting penetrants, and defoamants.

These nonionic surfactants have been known to enhance performances, such as detergency and emulsifying power by being combined, with other surfactants (J. Am. Oil. Chem. Soc. 62, 1139 (1985)). There are many techniques for the surfactant compositions containing these nonionic surfactants disclosed.

Nonionic surfactants produced by adding ethylene oxide to aliphatic alcohols have problems of reduction in fluidity and separation due to its high melting point and the tendency of easily forming a liquid crystal structure when mixed with water or other surfactant. For overcoming the problems from the viewpoint of ease of handling, there is a proposed method of combining ethylene oxide with propylene oxide or butylene oxide (JP-A 50-116384). Further, WO-A 2008/088647 discloses an alkoxylated nonionic surfactant derived from seed oil. DE-A 3607193, corresponding to U.S. Pat. No. B 4,832,868, discloses a surfactant mixture containing an ether alcohol added with ethylene oxide and/or propylene oxide. DE-A 3643895, corresponding to U.S. Pat. No. B 4,965,014, discloses a surfactant mixture containing an alcohol derivative added with ethylene oxide and/or propylene oxide.

SUMMARY OF THE INVENTION

The present invention relates to a nonionic surfactant represented by the formula (1):

$$R—O—(PO)_m\text{-}(EO)_n—H \quad (1)$$

wherein R represents a saturated linear-chain hydrocarbon group having 8 to 18 carbon atoms, n-octyl groups are 20 to 80% by mole of the saturated linear-chain hydrocarbon groups, n-decyl groups are 0 to 10% by mole of the saturated linear-chain hydrocarbon groups and saturated linear-chain hydrocarbon groups having 12 to 18 carbon atoms are 20 to 80% by mole of the saturated linear-chain hydrocarbon groups;

PO represents a propyleneoxy group;

EO represents an ethyleneoxy group;

m represents an average addition mole number of propyleneoxy groups ranging from 0.1 to 5;

n represents an average addition mole number of ethyleneoxy groups ranging from 0.5 to 20; and $(PO)_m$ and $(EO)_n$ are bonded as blocks in this order.

DETAILED DESCRIPTION OF THE INVENTION

The method of JP-A 50-116384 could not produce a surfactant satisfying both properties such as fluidity and stability when blended and performances such as detergency, emulsifying power, and quality of foam. There is thus a demand for further development.

The present invention provides a nonionic surfactant satisfying both properties of fluidity and stability when blended and performances such as detergency, and a liquid detergent composition containing the same. The liquid detergent composition of the present invention is preferably for clothes or for hard surfaces.

The nonionic surfactant of the present invention exhibits a good fluidity and stability when blended in a liquid detergent composition, and also exhibits a good detergency when used for washing as a liquid detergent composition.

The nonionic surfactant of the present invention can be used in detergents for clothes, for hard surfaces of dishes, plastics, and metals, and for bodies (e.g., hands and fingers, hears, face, and the like), and in emulsifier for makeups and cosmetics, in a solubilizer, in a wetting penetrant, and in a defoamant or a lubricant.

<Nonionic Surfactant Represented by the Formula (1)>

The nonionic surfactant of the present invention represented by the formula (1):

$$R—O—(PO)_m\text{-}(EO)_n—H \quad (1)$$

is a mixture of compounds having R's having different carbon numbers, respectively, within the specified ranges.

In the formula (1), R represents a saturated linear-chain hydrocarbon group having 8 to 18 carbon atoms. Of the saturated linear-chain hydrocarbon groups, n-octyl groups is 20 to 80% by mole, and from the viewpoint of fluidity of the surfactant itself or when blended with a liquid detergent composition, preferably 20 to 75% by mole, more preferably 30 to 70% by mole, and even more preferably 40 to 60% by mole.

Of the saturated linear-chain hydrocarbon groups having 8 to 18 carbon atoms, n-decyl groups is 0 to 10% by mole, and from the viewpoint of detergency and quality of foam when blended in a liquid detergent composition, preferably 0 to 5% by mole, and more preferably 0 to 1% by mole.

From the effects of the present invention, the lower the content of n-decyl groups is, the more preferable the nonionic surfactant is.

However, if a nonionic surfactant containing a compound of the formula (1) in which R represents an n-decyl group is not positively intended, it is possible that a compound of the formula (1) containing n-decyl group, derived from n-decanol contained in a starting alcohol as an impurity, is contained and the content of n-decyl groups is not less than 0.01% by mole in R's.

Of the saturated linear-chain hydrocarbon groups having 8 to 18 carbon atoms, saturated linear-chain hydrocarbon groups having 12 to 18 carbon atoms are 20 to 80% by mole, and from the viewpoint of detergency and quality of foam when blended in a liquid detergent composition, preferably 25 to 75% by mole, more preferably 30 to 70% by mole, and even more preferably 40 to 60% by mole.

From the viewpoints of fluidity of the surfactant itself, and detergency and quality of foam when blended in a liquid detergent composition, in the formula (1), R preferably represents a saturated linear-chain hydrocarbon group having 8 to 14 carbon atoms. In this case, the contents of n-octyl and n-decyl are the same as the contents of n-octyl and n-decyl, respectively, of the case where R represents a saturated linear-chain hydrocarbon group having 8 to 18 carbon atoms. Preferred ranges of the contents are also the same as those of the case where R has 8 to 18 carbon atoms. From the viewpoint of detergency and quality of foam when blended in a liquid detergent composition, a content ratio of saturated linear-chain hydrocarbon groups having 12 to 14 carbon atoms is preferably 20 to 80% by mole, more preferably 25 to 75% by mole, even more preferably 30 to 70% by mole, and still even more preferably 40 to 60% by mole.

In some cases, the nonionic surfactant contains compounds falling outside the formula (1) in which the number of carbon atoms of R is from 8 to 18, depending on a purity of a starting saturated aliphatic alcohol. The nonionic surfactant of the present invention may contain a compound of the formula (1) in which the number of carbon atoms of R is less than 8 (e.g., 6 or 7 carbon atoms) or more than 18 (e.g., 19 to 22 carbon atoms) in an amount of not more than 1% by mole.

In the formula (1), m represents an average addition mole number of propyleneoxy groups ranging from 0.1 to 5. From the viewpoints of fluidity, stability, and detergency when blended in a liquid detergent, the number is preferably 1 to 4, and more preferably 1.5 to 3.5.

In the formula (1), n represents an average addition mole number of ethyleneoxy groups ranging from 0.5 to 20. From the viewpoints of fluidity, stability, and quality of foam when blended in a liquid detergent, the number is preferably 1 to 15, and more preferably 1.5 to 12.

The nonionic surfactant represented by the formula (1) can be produced by the method described below, alternatively by mixing a product of the method or by producing a nonionic surfactant represented by the formula (1) having R of the specified carbon number according to the method and mixing it with a nonionic surfactant having a different number of carbon atoms.

In a reactor that can be heated, cooled, evacuated, and pressurized, equipped with an inlet of a starting material and an outlet of a product, feeding tubes of an alkylene oxide and nitrogen, a stirring device, a thermometer and a manometer, an aliphatic alcohol corresponding to R of the formula (1) of the present invention in a given amount is added, and a solid potassium hydroxide or a solid sodium hydroxide, or an aqueous solution thereof, is added. Subsequently the reactor is purged with nitrogen. The mixture is dehydrated under reduced pressure at a temperature ranging from an ambient temperature to 110° C. Then, given amounts of propylene oxide and ethylene oxide are added in this order at 80 to 180° C. to obtain an adduct.

In the process of producing an adduct, addition of given amounts of propylene oxide and ethylene oxide (operation of aging) is carried out and then the reaction is preferably allowed to proceed until the pressure of the reaction system decreases to a certain stable point. In the process, to the obtained crude product, a known acid is added in an appropriate amount to neutralize the catalyst, thereby obtaining the desired component. In neutralization, an alkali absorber may be used to remove the catalyst.

The nonionic surfactant of the present invention has a low pour point by itself and a good emulsifying power, and is suitably used in various detergents for clothes and for industries, and as an emulsifier for oils and solvents, an emulsifier for emulsion polymerization, a solubilizer, a wetting penetrant, a defoamant, and a lubricant.

<Liquid Detergent Composition>

In the liquid detergent composition of the present invention, a content of the nonionic surfactant represented by the formula (1) is 0.1 to 50% by mass, and from the viewpoints of detergency and quality of foam, preferably 0.5 to 40% by mass, and more preferably 1 to 30% by mass.

The liquid detergent composition of the present invention can contain other surfactant together with the nonionic surfactant represented by the formula (1) of the present invention in order to enhance stability of the composition, quality of foam, properties of rinsing off, detergency, and emulsifying power.

As the other surfactants, nonionic surfactants, anionic surfactants, cationic surfactants and amphoteric surfactants may be used.

Examples of the anionic surfactant include fatty acid salts, alkyl ether carboxylates, α-sulfofatty acid ester salts, alkylbenzenesulfonates, alkylsulfates, alkyl ether sulfuric acid ester salts, and the like. Examples of the cationic surfactant include alkyl ammonium salts, alkyl pyridinium salts, and the like. Examples of the amphoteric surfactant include alkyl carboxybetaines, alkyl sulfobetaines, alkyl amine oxides, and the like. Examples of other nonionic surfactants include polyoxyalkylene alkyl ethers, alkyl glycosides, sugar alkyl esters, fatty acid alkanolamides, and the like. When a polyoxyalkylene alkyl ether is incorporated, it is important to select a structure and an amount of the other polyoxyalkylene alkyl ether and solve the problems of the present invention, so that the surfactant composition, after combined with the polyoxyalkylene alkyl ether, may meet the formula (2):

$$R'—O—(PO)_q-(EO)_r—H \quad (2)$$

wherein, R' represents a saturated linear-chain hydrocarbon group; PO represents a propyleneoxy group; EO represents an ethyleneoxy group; q and r represent average addition mole numbers of propyleneoxy groups and ethyleneoxy groups, respectively; and $(PO)_q$ and $(EO)_r$ are bonded as blocks in this order, and may not be out of the formula (1).

In the liquid detergent composition of the present invention, the total amount of surfactants is preferably 0.1 to 90% by mass, and more preferably 1 to 80% by mass. Incases of the liquid detergent composition containing a nonionic surfactant other than the nonionic surfactant of the present invention represented by the formula (1), the nonionic surfactant of the formula (1) preferably accounts for not less than 1% by mass, more preferably not less than 2% by mass, and even more preferably not less than 5% by mass of the total of nonionic surfactants.

The liquid detergent composition of the present invention may further contain other additives within the range that the problems can be solved by the present invention, including higher fatty acids, solvents, known chelating agents, antiredeposition agents (e.g., polyethylene glycol, carboxymethyl cellulose, and the like), emulsifiers (e.g., polyvinyl acetate, vinyl acetate-styrene copolymer), polystyrenes, bleaches, enzymes, preservatives, inorganic salts, and the like.

The liquid detergent composition of the present invention is suitably used for clothes, hard surfaces, and bodies (including hairs).

EXAMPLES

The following experiments are intended to demonstrate the present invention and comparison and do not limit the present invention.

Examples will be described bellow. In Examples 1 to 8 and Comparative Examples 1 to 7, "$C_n$" represents a saturated linear-chain hydrocarbon group having the carbon number of n. "$C_n$—OH" represents a primary alcohol having a saturated linear-chain hydrocarbon group having the carbon number of n.

Example 1

Preparation of Nonionic Surfactant (1)

In an autoclave equipped with a stirrer, a temperature controller, and an automatic feeder, an alcohol mixture of 70.9 g of saturated linear $C_8$ alcohol [trade name: Kalcol 0898, purity 99.6%, manufactured by Kao Corporation], 70.9 g of saturated linear $C_{12}$ alcohol [trade name: Kalcol 2098, purity 99.6%, manufactured by Kao Corporation], and 15.8 g of saturated linear $C_{14}$ alcohol [trade name: Kalcol 4098, purity 99.6%, manufactured by Kao Corporation] ($C_8$—OH/$C_{12}$—OH/$C_{14}$—OH=54.5/38.1/7.4, molar ratio) and 1.1 g of potassium hydroxide were dehydrated for 30 minutes at 110° C. under 1.3 kPa. Then, the autoclave was purged with nitrogen.

After the nitrogen purge, at an elevated temperature of 125° C., 145.2 g of propylene oxide was added to produce an adduct and allowed to progress in aging. Then, at a further elevated temperature of 150° C., to the mixture, 220.3 g of ethylene oxide was added to produce an adduct and allowed to progress in aging. After completed the reaction, the mixture was cooled to 80° C. To the autoclave, 1.2 g of acetic acid was added. The mixture was stirred at 80° C. for 30 minutes and extracted to obtain a nonionic surfactant (1) according to the present invention [in the formula (1), R's: $C_8/C_{12}/C_{14}$=54.5/38.1/7.4 (molar ratio), m=2.5, n=5].

Example 2

Preparation of Nonionic Surfactant (2)

In an autoclave equipped with a stirrer, a temperature controller, and an automatic feeder, an alcoholic mixture of 76.6 g of Kalcol 0898 and 76.4 g of Kalcol 2098, which were used in Example 1 ($C_8$—OH/$C_{12}$—OH=58.9/41.1, molar ratio) and 1.1 g of potassium hydroxide were fed and dehydrated for 30 minutes at 110° C. under 1.3 kPa. Then, the autoclave was purged with nitrogen.

After the nitrogen purge, at an elevated temperature of 125° C., 145.2 g of propylene oxide was added to produce an adduct and allowed to progress in aging. Then, at a further elevated temperature of 150° C., to the mixture, 66.1 g of ethylene oxide was added to produce an adduct and allowed to progress the reaction for aging. After completed the reaction, the mixture was cooled to 80° C. To the autoclave, 1.2 g of acetic acid was added. The mixture was stirred for 30 minutes at 80° C. and extracted to obtain a nonionic surfactant (2) according to the present invention [in the formula (1), R's: $C_8/C_{12}$=58.9/41.1 (molar ratio), m=2.5, n=5].

Example 3

Preparation of Nonionic Surfactant (3)

In an autoclave equipped with a stirrer, a temperature controller, and an automatic feeder, an alcoholic mixture of 76.6 g of Kalcol 0898 used in Example 1, 6.2 g of saturated linear $C_{10}$ alcohol [trade name: Kalcol 1098, purity 99.6%, manufactured by Kao Corporation], and 69.2 g of Kalcol 2098 used in Example 1 ($C_8$—OH/$C_{10}$—OH/$C_{12}$—OH=58.9/3.9/37.2, molar ratio) and 1.1 g of potassium hydroxide were fed and dehydrated for 30 minutes at 110° C. under 1.3 kPa. Then, the autoclave was purged with nitrogen.

After the nitrogen purge, at an elevated temperature of 125° C., 174.2 g of propylene oxide was added to produce an adduct and allowed to progress in aging. Then, at a further elevated temperature of 150° C., to the mixture, 308.4 g of ethylene oxide was added to produce an adduct and allowed to progress in aging. After completed the reaction, the mixture was cooled to 80° C. To the autoclave, 1.2 g of acetic acid was added. The mixture was stirred for 30 minutes at 80° C. and extracted to obtain a nonionic surfactant (3) according to the present invention [in the formula (1), R's: $C_8/C_{10}/C_{12}$=58.9/3.9/37.2 (molar ratio), m=3, n=7].

Comparative Example 1

Preparation of Nonionic Surfactant (4)

In an autoclave equipped with a stirrer, a temperature controller, and an automatic feeder, an alcoholic mixture of 76.6 g of Kalcol 0898 and 76.4 g of Kalcol 2098, which were used in Example 1 ($C_8$—OH/$C_{12}$—OH=58.9/41.1, molar ratio) and 1.1 g of potassium hydroxide were inserted and dehydrated for 30 minutes at 110° C. under 1.3 kPa. Then, the autoclave was purged with nitrogen.

Then, at an elevated temperature of 150° C., to the mixture, 308.4 g of ethylene oxide was added to produce an adduct and allowed to progress in aging. After completed the reaction, the mixture was cooled to 80° C. To the autoclave, 1.2 g of acetic acid was added. The mixture was stirred for 30 minutes at 80° C. and extracted to obtain a nonionic surfactant (4) [in the formula (1), R's: $C_8/C_{12}$=58.9/41.1 (molar ratio), m=0, n=7].

Comparative Example 2

Preparation of Nonionic Surfactant (5)

In an autoclave equipped with a stirrer, a temperature controller, and an automatic feeder, an alcoholic mixture of 138.9 g of Kalcol 2098 and 54.1 g of Kalcol 4098, which were used in Example 1 ($C_{12}$—OH/$C_{14}$—OH=74.7/25.3, molar ratio) and 1.1 g of potassium hydroxide were fed and dehydrated for 30 minutes at 110° C. under 1.3 kPa. Then, the autoclave was purged with nitrogen.

After the nitrogen purge, at an elevated temperature of 125° C., 145.2 g of propylene oxide was added to produce an adduct and allowed to progress in aging. Then, at a further elevated temperature of 150° C., to the mixture, 220.3 g of ethylene oxide was added to produce an adduct and allowed to progress in aging. After completed the reaction, the mixture was cooled to 80° C. To the autoclave, 1.2 g of acetic acid was added. The mixture was stirred for 30 minutes at 80° C. and extracted to obtain a nonionic surfactant (5) [in the formula (1), R's: $C_{12}/C_{14}$=74.7/25.3 (molar ratio), m=2.5, n=5].

Comparative Example 3

Preparation of Nonionic Surfactant (6)

In an autoclave equipped with a stirrer, a temperature controller, and an automatic feeder, an alcoholic mixture of 74.0 g of Kalcol 0898, 55.9 g of Kalcol 1098, and 14.3 g of Kalcol 2098, which were used in Example 1 or 3 ($C_8$—OH/$C_{10}$—OH/$C_{12}$—OH=53.0/38.8/8.2, molar ratio) and 1.1 g of potassium hydroxide were fed and dehydrated for 30 minutes at 110° C. under 1.3 kPa. Then, the autoclave was purged with nitrogen.

After the nitrogen purge, at an elevated temperature of 125° C., 145.2 g of propylene oxide was added to produce an adduct and allowed to progress in aging. Then, at a further elevated temperature of 150° C., to the mixture, 220.3 g of ethylene oxide was added to produce an adduct and allowed to progress in aging. After completed the reaction, the mixture was cooled to 80° C. To the autoclave, 1.2 g of acetic acid was added. The mixture was stirred for 30 minutes at 80° C.

and extracted to obtain a nonionic surfactant (6) [in the formula (1), R's: $C_8/C_{10}/C_{12}$=53.0/38.8/8.2 (molar ratio), m=2.5, n=5].

Comparative Example 4

Preparation of Nonionic Surfactant (7)

In an autoclave equipped with a stirrer, a temperature controller, and an automatic feeder, an alcoholic mixture of 47.3 g of Kalcol 0898, 55.3 g of Kalcol 1098, 39.4 g of Kalcol 2098, and 15.8 g of Kalcol 4098, which were used in Example 1 or 3 ($C_8$—OH/$C_{10}$—OH/$C_{12}$—OH/$C_{14}$—OH=36.4/35.0/21.2/7.4, molar ratio) and 1.1 g of potassium hydroxide were inserted and dehydrated for 30 minutes at 110° C. under 1.3 kPa. Then, the autoclave was purged with nitrogen.

After the nitrogen purge, at an elevated temperature of 125° C., 145.2 g of propylene oxide to produce an adduct and allowed was added to progress in aging. Then, at a further elevated temperature of 150° C., to the mixture, 220.3 g of ethylene oxide was added to produce an adduct and allowed to progress in aging. After completed the reaction, the mixture was cooled to 80° C. To the autoclave, 1.2 g of acetic acid was added. The mixture was stirred for 30 minutes at 80° C. and extracted to obtain a nonionic surfactant (7) [in the formula (1), R's: $C_8/C_{10}/C_{12}/C_{14}$=36.4/35.0/21.2/7.4 (molar ratio), m=2.5, n=5].

Comparative Example 5

Preparation of Nonionic Surfactant (8)

In an autoclave equipped with a stirrer, a temperature controller, and an automatic feeder, an alcoholic mixture of 76.6 g of Kalcol 0898 and 76.4 g of Kalcol 2098, which were used in Example 1 ($C_8$—OH/$C_{12}$—OH=58.9/41.1, molar ratio) and 1.1 g of potassium hydroxide were fed and dehydrated for 30 minutes at 110° C. under 1.3 kPa. Then, the autoclave was purged with nitrogen.

After the nitrogen purge, at an elevated temperature of 125° C., 145.2 g of propylene oxide was added to produce an adduct and allowed to progress in aging. Then, at a further elevated temperature of 150° C., to the mixture, 1101.3 g of ethylene oxide was added to produce an adduct and allowed to progress the reaction for aging. After completed the reaction, the mixture was cooled to 80° C. To the autoclave was added 1.2 g of acetic acid. The mixture was stirred for 30 minutes at 80° C. and extracted to obtain a nonionic surfactant (8) [in the formula (1), R's: $C_8/C_{12}$=58.9/41.1 (molar ratio), m=2.5, n=25].

Comparative Example 6

Preparation of Nonionic Surfactant (9)

In an autoclave equipped with a stirrer, a temperature controller, and an automatic feeder, 194 g of synthetic alcohol (trade name: SAFOL23 (manufactured by SASOL), a saturated alcohol having $C_{12}$ and $C_{13}$ branched alkyl groups ($C_{12}/C_{13}$=55/45, molar ratio) and a branching rate (weight proportion of branched alcohols) of 50% by mass) and 1.1 g of potassium hydroxide were fed and dehydrated for 30 minutes at 110° C. under 1.3 kPa. Then, the autoclave was purged with nitrogen.

After the nitrogen purge, at an elevated temperature of 125° C., 145.2 g of propylene oxide was added to produce an adduct and allowed to progress the reaction for aging. Then, at a further elevated temperature of 150° C., to the mixture, 220.3 g of ethylene oxide was added to produce an adduct and allowed to progress the reaction for aging. After completed the reaction, the mixture was cooled to 80° C. To the autoclave, 1.2 g of acetic acid was added. The mixture was stirred for 30 minutes at 80° C. and extracted to obtain a nonionic surfactant (9) [in the formula (1), R's contained a branched alkyl group, m=2.5, n=5].

Examples 4 to 8 and Comparative Examples 7

In Examples 4 to 8 and Comparative Examples 7, nonionic surfactants (A) to (E) and (F) were prepared, respectively.

In the same reactor as in Example 1, each 150.0 g of alcoholic mixtures of Kalcol 0898, Kalcol 1098, and Kalcol 2098, which were used in Example 3, in compositions of linear saturated hydrocarbon group Rs (% by mole) as shown in columns A to E and F in Table 1 and 1.1 g of potassium hydroxide were fed and dehydrated under the same conditions as in Example 1. Then, each mixture was processed under the same conditions as in Example 1, except that propylene oxide and ethylene oxide were added in such amounts as corresponding to addition mole numbers of PO (m) and EO (n) as shown in columns A to E and F in Table 1 to obtain nonionic surfactants (A) to (E) and (F) shown in Table 1.

Nonionic surfactants (1) to (9), (A) to (E), and (F) prepared in Examples 1 to 8, and Comparative Examples 1 to 7 were evaluated for the pour point, emulsifying power, and fluidity according to the following methods. Results are shown in Table 1.

(1) Pour Point

A pour point of a nonionic surfactant was measured in accordance with the method of JIS K-2269.

(2) Emulsifying Power 4.0 g of triolein, squalane, and oleic acid as oils to be emulsified and 0.4 g of nonionic surfactant were placed in a graduated test tube and stirred for 30 seconds with a touch mixer for test tube. To the mixture, 5.6 g of distilled water was added, and stirred for additional one minute with the touch mixer. The test tube was allowed to stand for 2 hours. Then, an emulsion was measured about a layer of separated water to evaluate emulsifying performance of the nonionic surfactant according to the following equation:

emulsifying power(%)=(amount of water fed−separated water)(ml)/amount of water fed(ml)×100

(3) Fluidity

A nonionic surfactant was mixed with ion-exchanged water so as to obtain an intended concentration in increments of 10% by mass within the range of 10 to 90% by mass. The mixtures were allowed to stand for one day at 25° C., and visually judged as to whether they flowed, when inclined, to evaluate fluidity.

○: having fluidity

X: no fluidity

TABLE 1

| | | Example | | | | | | | | Comparative example | | | | | | |
|---|---|---|---|---|---|---|---|---|---|---|---|---|---|---|---|---|
| | | 1 | 2 | 3 | 4 | 5 | 6 | 7 | 8 | 1 | 2 | 3 | 4 | 5 | 6 | 7 |
| Nonionic surfactant | | (1) | (2) | (3) | (A) | (B) | (C) | (D) | (E) | (4) | (5) | (6) | (7) | (8) | (9) | (F) |
| Composition of straight-chain saturated hydrocarbon group R (mole- %) Note 1 | 8 | 54.5 | 58.9 | 58.9 | 45 | 40 | 58.9 | 58.9 | 58.9 | 58.9 | — | 53.0 | 36.4 | 58.9 | — | 40 |
| | 10 | — | — | 3.9 | 10 | — | — | — | — | — | — | 38.8 | 35.0 | 0.02 | — | 15 |
| | 12 | 38.1 | 41.1 | 37.2 | 45 | 60 | 41.1 | 41.1 | 41.1 | 41.1 | 74.7 | 8.2 | 21.2 | 41.1 | — | 45 |
| | 14 | 7.4 | — | — | — | — | — | — | — | — | 25.3 | — | 7.4 | — | — | — |
| Mole number of PO added(m) | | 2.5 | 2.5 | 3 | 2.5 | 2.5 | 3 | 1.5 | 3.5 | — | 2.5 | 2.5 | 2.5 | 2.5 | 2.5 | 2.5 |
| Mole number of EO added(n) | | 5 | 1.5 | 7 | 5 | 5 | 9 | 5 | 5 | 7 | 5 | 5 | 5 | 25 | 5 | 5 |
| pour point (° C.) | | −8 | −60 | −1 | −20 | −37 | 4 | −5 | −45 | 21 | 12 | −15 | −10 | 42 | −14 | −11 |
| Emulsifying power (%) | Triolein | 54 | 72 | 48 | 50 | 60 | 50 | 50 | 65 | 38 | 44 | 25 | 32 | 15 | 25 | 45 |
| | Squarane | 85 | 100 | 56 | 80 | 90 | 60 | 55 | 80 | 45 | 92 | 58 | 63 | 12 | 36 | 65 |
| | Oleic acid | 92 | 78 | 100 | 95 | 90 | 95 | 95 | 90 | 100 | 84 | 90 | 85 | 100 | 70 | 80 |
| | Emulsifying performance | 231 | 250 | 204 | 225 | 240 | 205 | 200 | 235 | 183 | 220 | 173 | 180 | 127 | 131 | 190 |
| Fluidity | 10% | ○ | ○ | ○ | ○ | ○ | ○ | ○ | ○ | ○ | ○ | ○ | ○ | ○ | ○ | ○ |
| | 20% | ○ | ○ | ○ | ○ | ○ | ○ | ○ | ○ | ○ | ○ | ○ | ○ | ○ | ○ | ○ |
| | 30% | ○ | ○ | ○ | ○ | ○ | ○ | ○ | ○ | ○ | ○ | ○ | ○ | ○ | ○ | ○ |
| | 40% | ○ | ○ | ○ | ○ | ○ | ○ | ○ | ○ | x | x | ○ | ○ | ○ | ○ | ○ |
| | 50% | ○ | ○ | ○ | ○ | ○ | ○ | ○ | ○ | x | x | ○ | ○ | x | x | ○ |
| | 60% | ○ | ○ | ○ | ○ | ○ | ○ | ○ | ○ | x | x | ○ | ○ | x | x | ○ |
| | 70% | ○ | ○ | ○ | ○ | ○ | ○ | ○ | ○ | x | x | ○ | ○ | x | ○ | x |
| | 80% | ○ | ○ | ○ | ○ | ○ | ○ | ○ | ○ | ○ | ○ | ○ | ○ | x | ○ | ○ |
| | 90% | ○ | ○ | ○ | ○ | ○ | ○ | ○ | ○ | ○ | ○ | ○ | ○ | ○ | ○ | ○ |
| | 100% | ○ | ○ | ○ | ○ | ○ | ○ | ○ | ○ | ○ | ○ | ○ | ○ | x | ○ | ○ |

Examples 9 to 16 and Comparative Examples 8 to 14

Preparation of Dishwashing Liquid Detergent Composition

Dishwashing liquid detergent compositions were prepared according to formulations shown in Table 2, and evaluated for stability (appearance), texture of foam (quality of foam), rinsing off property, and detergency according to the following methods. Results are shown in Table 2.

[Stability (Appearance)]

40 ml of detergent composition was placed and sealed in a 50 ml colorless and transparent glass bottle, and allowed to stand for 3 days at 0° C. Then, an appearance of the composition was visually observed. The criteria are as follows.

○: uniform and clear

X: clouded or separated

[Texture of Foam (Quality of Foam)]

A commercially available sponge (manufactured by Sumitomo 3M Limited: Scotch Brite) was impregnated with 1 g of composition shown in Table 2 and 30 g of tap water, and clasped and unclasped two or three times with a hand to bubble. A texture of foam thus generated was evaluated by five panelists according to the following criteria. An average of evaluation scores was rated as follows: ○ for not less than 1.5, Δ for not less than 1 and less than 1.5, and X for less than 1. Results are shown in Table 2.

2: Foam had a creamy texture and kept well

1: Foam was relatively coarse and faded fast

0: Foam was coarse and faded fast

[Rinsing Off Property]

Rapeseed oil and beef tallow were mixed at a mass ratio of 1:1. To the mixture, 0.1% by mass of a dye (Sudan red) was added and uniformly mixed to obtain a model oil for staining. 1 g of the model oil was uniformly spread over a ceramic dish to obtain a stained dish model.

A commercially available sponge (manufactured by Sumitomo 3M Limited: Scotch Brite) was impregnated with 1 g of composition shown in Table 2 and 30 g of tap water, and clasped and unclasped two or three times with a hand to bubble. A stained dish model was rubbed with the sponge and rinsed with tap water. Ease of vanishing a slimy feeling during rinsing was sensory evaluated by five panelists according to the following criteria. An average of evaluation scores was rated as follows: ○ for not less than 1.5, Δ for not less than 1 and less than 1.5, and X for less than 1. Results are shown in Table 2.

2: A slimy feeling vanished fast

1: A slimy feeling taken a little time to vanish away

0: A slimy feeling taken a time to vanish away

[Detergency]

A commercially available sponge (manufactured by Sumitomo 3M Limited: Scotch Brite) was impregnated with 1 g of composition shown in Table 2 and 30 g of tap water, and clasped and unclasped two or three times with a hand to bubble. A stained dish model was rubbed with the sponge. The number of dishes cleaned (visually confirmed the absence of the stained color on a dish) was determined.

TABLE 2

| | | | Example | | | | | | | | Comparative example | | | | | | |
|---|---|---|---|---|---|---|---|---|---|---|---|---|---|---|---|---|---|
| | | | 9 | 10 | 11 | 12 | 13 | 14 | 15 | 16 | 8 | 9 | 10 | 11 | 12 | 13 | 14 |
| Dishwashing liquid detergent composition | Nonionic surfactant | Kind | (1) | (2) | (3) | (A) | (B) | (C) | (D) | (E) | (4) | (5) | (6) | (7) | (8) | (9) | (F) |
| | | Compounding amount(%) | 5 | 5 | 5 | 5 | 5 | 5 | 5 | 5 | 5 | 5 | 5 | 5 | 5 | 5 | 5 |
| | Sodium polyoxyethylene(3) lauryl ether sulfate | | 15 | 15 | 15 | 15 | 15 | 15 | 15 | 15 | 15 | 15 | 15 | 15 | 15 | 15 | 15 |
| | N-lauryl-N, N- | | 2 | 2 | 2 | 2 | 2 | 2 | 2 | 2 | 2 | 2 | 2 | 2 | 2 | 2 | 2 |

TABLE 2-continued

| | | Example | | | | | | | | Comparative example | | | | | | |
|---|---|---|---|---|---|---|---|---|---|---|---|---|---|---|---|---|
| | | 9 | 10 | 11 | 12 | 13 | 14 | 15 | 16 | 8 | 9 | 10 | 11 | 12 | 13 | 14 |
| | dimethyl amineoxide | | | | | | | | | | | | | | | |
| | $MgCl_2 \cdot 6H_2O$ | 4 | 4 | 4 | 4 | 4 | 4 | 4 | 4 | 4 | 4 | 4 | 4 | 4 | 4 | 4 |
| | Ethanol | 7 | 7 | 7 | 7 | 7 | 7 | 7 | 7 | 7 | 7 | 7 | 7 | 7 | 7 | 7 |
| | $PTS \cdot H_2O$ | 3 | 3 | 3 | 3 | 3 | 3 | 3 | 3 | 3 | 3 | 3 | 3 | 3 | 3 | 3 |
| | Citric acid | 1 | 1 | 1 | 1 | 1 | 1 | 1 | 1 | 1 | 1 | 1 | 1 | 1 | 1 | 1 |
| | Ion-exchange water | Balance | Balance | Balance | Balance | Balance | Balance | Balance | Balance | Balance | Balance | Balance | Balance | Balance | Balance | Balance |
| | Total (mass %) | 100 | 100 | 100 | 100 | 100 | 100 | 100 | 100 | 100 | 100 | 100 | 100 | 100 | 100 | 100 |
| | pH (20° C.) | 7 | 7 | 7 | 7 | 7 | 7 | 7 | 7 | 7 | 7 | 7 | 7 | 7 | 7 | 7 |
| Evaluation | Appearance | ○ | ○ | ○ | ○ | ○ | ○ | ○ | ○ | x | x | ○ | ○ | x | x | ○ |
| | Foam quality | ○ | ○ | ○ | ○ | ○ | ○ | ○ | ○ | ○ | ○ | Δ | Δ | x | Δ | Δ |
| | Rinsing | ○ | ○ | ○ | ○ | ○ | ○ | ○ | ○ | x | x | Δ | Δ | ○ | x | Δ |
| | Detergency (sheet) | 12 | 12 | 11 | 12 | 12 | 12 | 12 | 12 | 10 | 11 | 8 | 9 | 6 | 8 | 10 |

A pH was adjusted with sodium hydroxide and/or sulfuric acid.

Examples 17 to 24 and Comparative Examples 15 to 21

Preparation of Liquid Detergent Composition for Clothes

Liquid detergent compositions for clothes were prepared according to formulations shown in Table 3, and evaluated for stability (appearance) and detergency according to the following methods. Results are shown in Table 3.

[Stability (Appearance)]

40 ml of detergent composition was placed and sealed in a 50 ml clear colorless and transparent glass bottle, and allowed to stand for 3 days at 0° C. Then, an appearance of the composition was visually observed. The criteria are as follows.

○: uniform and clear

X: clouded or separated

[Preparation of Artificial Grimy Cloth]

To 75 L of ethylene tetrachloride, 1531.2 g of organic grime and 240 g of carbon paste were added, compositions of which were described below, and sonicated for 10 minutes to disperse. A washed cloth (wool muslin) of 10 cm width was immersed in the bath thus prepared, and dried in the air to obtain a grimy cloth. The grimy cloth was cut into pieces having the dimensions of 10 cm by 10 cm for subjecting to a washing test.

(Composition of the Organic Grime)

cottonseed oil 44.8%, cholesterol 10.8%, oleic acid 10.8%, palmitic acid 7.8%, cetyl alcohol 2.0%, solid paraffin 5.1%, liquid paraffin 5.1% (86.4% by mass in total)

(Composition of the Carbon Paste)

Asahi carbon black 0.2%, cottonseed oil 13.4% (13.6% by mass in total).

A washed cloth (wool muslin) having the dimensions of 120 cm by 40 cm was folded in half (60 cm by 40 cm) and stitched up in a cylindrical form. On the center part of one surface (front side) thereof, three sheets of the grimy cloth were sewn to obtain a test cloth.

[Detergency]

Liquid detergent compositions for clothes shown in Table 3 were evaluated for detergency in accordance with JIS K3362: 1998, a method for evaluating detergency of a detergent for clothes. A liquid detergent composition was used at a concentration of 0.83 g/L. In this test, a detergency (% of washing rate) was calculated from changes in a surface reflectance of the artificial grimy cloth, before and after washing, measured with a surface reflectance analyzer according to the following equation.

$$\text{washing rate}(\%)=(\text{reflectance after washing}-\text{reflectance before washing})/(\text{reflectance of original cloth}-\text{reflectance before washing})\times 100$$

1: washing rate of not less than 50%

2: washing rate of not less than 40% and less than 50%

3: washing rate of less than 40%

TABLE 3

| | | | Example | | | | | | | | Comparative example | | | | | | |
|---|---|---|---|---|---|---|---|---|---|---|---|---|---|---|---|---|---|
| | | | 17 | 18 | 19 | 20 | 21 | 22 | 23 | 24 | 15 | 16 | 17 | 18 | 19 | 20 | 21 |
| Composition for liquid detergent for fubrics | Nonionic surfactant | Kind | (1) | (2) | (3) | (A) | (B) | (C) | (D) | (E) | (4) | (5) | (6) | (7) | (8) | (9) | (F) |
| | | Compounding amount(%) | 5 | 5 | 5 | 5 | 5 | 5 | 5 | 5 | 5 | 5 | 5 | 5 | 5 | 5 | 5 |
| | Polyoxyethylene(8) lauryl ether | | 25 | 25 | 25 | 25 | 25 | 25 | 25 | 25 | 25 | 25 | 25 | 25 | 25 | 25 | 25 |
| | Straight-chain alkyl benzene sulfonic sodium | | 5 | 5 | 5 | 5 | 5 | 5 | 5 | 5 | 5 | 5 | 5 | 5 | 5 | 5 | 5 |
| | Propylene glycol | | 3 | 3 | 3 | 3 | 3 | 3 | 3 | 3 | 3 | 3 | 3 | 3 | 3 | 3 | 3 |
| | Ethanol | | 2 | 2 | 2 | 2 | 2 | 2 | 2 | 2 | 2 | 2 | 2 | 2 | 2 | 2 | 2 |
| | Sodium sulfite | | 0.1 | 0.1 | 0.1 | 0.1 | 0.1 | 0.1 | 0.1 | 0.1 | 0.1 | 0.1 | 0.1 | 0.1 | 0.1 | 0.1 | 0.1 |
| | Citric acid | | 3 | 3 | 3 | 3 | 3 | 3 | 3 | 3 | 3 | 3 | 3 | 3 | 3 | 3 | 3 |
| | Ion-exchanged water | | Balance | Balance | Balance | Balance | Balance | Balance | Balance | Balance | Balance | Balance | Balance | Balance | Balance | Balance | Balance |
| | Total (mass %) | | 100 | 100 | 100 | 100 | 100 | 100 | 100 | 100 | 100 | 100 | 100 | 100 | 100 | 100 | 100 |
| | pH (20° C.) | | 7 | 7 | 7 | 7 | 7 | 7 | 7 | 7 | 7 | 7 | 7 | 7 | 7 | 7 | 7 |

TABLE 3-continued

| | | Example | | | | | | | | Comparative example | | | | | | |
|---|---|---|---|---|---|---|---|---|---|---|---|---|---|---|---|---|
| | | 17 | 18 | 19 | 20 | 21 | 22 | 23 | 24 | 15 | 16 | 17 | 18 | 19 | 20 | 21 |
| Evaluation | Appearance | ○ | ○ | ○ | ○ | ○ | ○ | ○ | ○ | x | x | ○ | x | x | x | ○ |
| | Detergency | 1 | 1 | 1 | 1 | 1 | 1 | 1 | 1 | 1 | 1 | 3 | 2 | 3 | 2 | 2 |

A pH was adjusted with sodium hydroxide and/or sulfuric acid.

The invention claimed is:

1. A nonionic surfactant represented by the formula (I):

$$R—O—(PO)_m-(EO)_n—H \quad (1)$$

wherein, R represents a saturated linear-chain hydrocarbon group having 8 to 18 carbon atoms, n-octyl groups are 20 to 80% by mole of the saturated linear-chain hydrocarbon groups, n-decyl groups are 0 to 10% by mole of the saturated linear-chain hydrocarbon groups and saturated linear-chain hydrocarbon groups having 12 to 18 carbon atoms are 20 to 80% by mole of the saturated linear-chain hydrocarbon groups;

PO represents a propyleneoxy group;

EO represents an ethyleneoxy group;

m represents an average addition mole number of propyleneoxy groups ranging from 0.1 to 5;

n represents an average addition mole number of ethyleneoxy groups ranging from 0.5 to 20; and $(PO)_m$ and $(EO)_n$ are bonded as blocks in this order.

2. The nonionic surfactant according to claim 1, wherein the content of n-octyl groups in R is 40 to 60% by mole.

3. The nonionic surfactant according to claim 1, wherein the content of n-decyl groups in R is 0 to 5% by mole.

4. The nonionic surfactant according to claim 1, wherein the saturated linear-chain hydrocarbon groups having 12 to 18 carbon atoms in R is 40 to 60% by mole.

5. The nonionic surfactant according to claim 1, wherein the saturated linear-chain hydrocarbon groups having 12 to 14 carbon atoms in R is 40 to 60% by mole.

6. The nonionic surfactant according to claim 1, wherein the average addition mole number of propyleneoxy groups, m, ranges from 1.5 to 3.5.

7. The nonionic surfactant according to claim 1, wherein the average addition mole number of ethyleneoxy groups, n, ranges from 1.5 to 12.

8. The nonionic surfactant according to claim 1, obtained by adding propylene oxide and ethylene oxide to an aliphatic alcohol corresponding to R of the formula (1) in this order.

9. A liquid detergent composition, comprising the nonionic surfactant according to claim 1 in an amount of 0.1 to 50% by mass.

10. A liquid detergent composition, comprising the nonionic surfactant according to claim 1 in an amount of 1 to 30% by mass.

* * * * *